US006172614B1

(12) United States Patent
Robison et al.

(10) Patent No.: US 6,172,614 B1
(45) Date of Patent: Jan. 9, 2001

(54) METHOD AND APPARATUS FOR REMOTE ACTUATION OF A DOWNHOLE DEVICE USING A RESONANT CHAMBER

(75) Inventors: Clark Robison, Plano; Wallace R. Gardner; John W. Minear, both of Houston, all of TX (US)

(73) Assignee: Halliburton Energy Services, Inc., Dallas, TX (US)

( * ) Notice: Under 35 U.S.C. 154(b), the term of this patent shall be extended for 0 days.

(21) Appl. No.: 09/114,456

(22) Filed: Jul. 13, 1998

(51) Int. Cl.[7] ..... G01V 3/00

(52) U.S. Cl. ..... 340/853.3; 340/854.3; 367/83

(58) Field of Search ..... 340/853.3, 855.4, 340/855.6, 854.3; 367/81, 83

(56) References Cited

U.S. PATENT DOCUMENTS

| | | | |
|---|---|---|---|
| 3,737,845 | 6/1973 | Maroney . | |
| 3,906,435 | 9/1975 | Lamel . | |
| 4,862,426 | 8/1989 | Cassity . | |
| 4,908,804 | 3/1990 | Rorden . | |
| 4,986,350 | 1/1991 | Czernichow . | |
| 5,067,114 | 11/1991 | Rorden . | |
| 5,166,908 | 11/1992 | Montgomery . | |
| 5,272,680 | 12/1993 | Stone . | |
| 5,293,937 | 3/1994 | Schultz . | |
| 5,343,963 | 9/1994 | Bouldin . | |
| 5,363,094 | 11/1994 | Staron . | |
| 5,535,177 | 7/1996 | Chin . | |
| 5,546,359 | 8/1996 | Aarseth . | |
| 5,579,283 | 11/1996 | Owens . | |
| 5,696,733 | 12/1997 | Zinn . | |
| 5,995,449 * | 11/1999 | Green et al. | 367/83 |

* cited by examiner

*Primary Examiner*—Michael Horabik
*Assistant Examiner*—Timothy Edwards, Jr.
(74) *Attorney, Agent, or Firm*—Paul I. Herman; David W. Carstens

(57) ABSTRACT

The method of remotely actuating a downhole device provides the initiation of an acoustic signal. The acoustic signal is amplified within a resonance chamber and is transmitted down a fluid column in the tubing string or in the annulus around the tubing string. The signal can be coded to allow activation of multiple downhole devices. The use of a resonance chamber allows for the amplification of the actuation signal to ensure that a downhole receiver can detect it. The receiver can be either a transducer or a hydrophone. The apparatus and method allow for remote actuation without the need for intervention into the well.

18 Claims, 2 Drawing Sheets

METHOD AND APPARATUS FOR REMOTE ACTUATION OF A DOWNHOLE DEVICE USING A RESONANT CHAMBER

BACKGROUND OF THE INVENTION

1. Technical Field

The present invention relates to a method and apparatus for remotely actuating a downhole device such as a packer. Specifically, the method involves the use of a resonant chamber to produce a signal detectable by a receiver/actuator coupled to the downhole device.

2. Description of the Related Art

The creation of an oil well involves two phases, drilling and completion. During the drilling of a well, a bit may be suspended along with related equipment from a drill string. The drill string is suspended from the crown block of a derrick by cables which bear a portion of the drill strings weight. The drill string and bit are rotated by a rotary table, driving the bit into the ground. A drilling mud can be circulated through the drill string to clean and cool the bit. The circulating mud also carries debris from the hole by way of the annulus between the drill string and the walls of the well. As the well becomes deeper, additional sections of drill string are added. Further, devices can be added to the drill string to help steer the bit or to perform early testing of the formation. If a well does not encounter commercial amounts of gas and oil, the well can be plugged and abandoned. However, if significant amounts of gas or oil are found, the well is completed.

During the completion of a well, casing can be cemented against the inside of the well to stabilize the wall of the well. A completion string can then be lowered into the cased well. The completion string can include packers to isolate specific portions of the well, perforation guns used to provide communication ports between the casing and surrounding formation, and other devices. Sometimes the downhole tools are actuated during the completion process. Other times, it is desirable to wait until the reservoir conditions merit the use of the specific tools. Therefore, a need exists for a method and apparatus to remotely actuate downhole tools during drilling, during completion, and after completion. It is important that such a method be non-interventional; in other words, nothing should have to be run into the well to actuate the downhole device.

U.S. Pat. No. 5,579,283 to Owens et al. and entitled "Method and Apparatus for Communicating Coded Messages in a Wellbore" discloses a method of impressing a command message upon a fluid column between a transmission node and a reception node. A transmission apparatus is in communication with the fluid column, for altering pressure of the fluid column to generate a portion of the coded message. A reception apparatus is provided at the reception node. The reception apparatus includes a rigid structural component with an exterior surface which is in direct contact with the fluid column and an interior surface which is not in direct contact with the fluid column, and a sensor assembly which detects elastic deformation of the rigid structural component. However, the well bore must contain only fluid of the same density to properly work. This might require the circulation of the drilling fluid to purge any gases.

A need exists for a method of remote actuation which allows an actuation signal to be transmitted down either an annulus or within the tool string. Such a device should be tunable to maximize the signal strength and to compensate for the geometry of the transmission path.

SUMMARY OF THE INVENTION

The present invention provides a non-interventional method of actuating downhole tools during production, completion, or after completion. The method involves the use of an actuation signal being initiated in a resonance chamber. The signal is at least partially reflected within the chamber in such a way that the amplitude of the signal builds upon itself it until reaches a sufficient amplitude. The signal can have a sinusoidal waveform with an initial amplitude and frequency. The signal can be initiated with a signal generator. If the frequency is in the audible range, the signal can be transmitted with a speaker into the resonance chamber. The resonance chamber will build the amplitude of the signal but not substantially alter its frequency. The frequency can be altered to meet the needs of the particular geometry of the well.

In one embodiment, a coded sequence of acoustic tone-bursts are transmitted from an acoustic signaling device mounted in a fluid-filled chamber attached to the fluid-filled tubing. The signal is received downhole by a battery-powered telemetry receiver containing an acoustic pressure transducer. By changing the coding and timing of the tone burst sequence, a large number of isolated devices can be separately addressed and actuated. The acoustic transmitter can be any number of devices including a piezo-electric stack, an electro-hydraulic piston, a sleeve gun, or a simple sonar device such as those used on fish finders.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION

Figure 1:
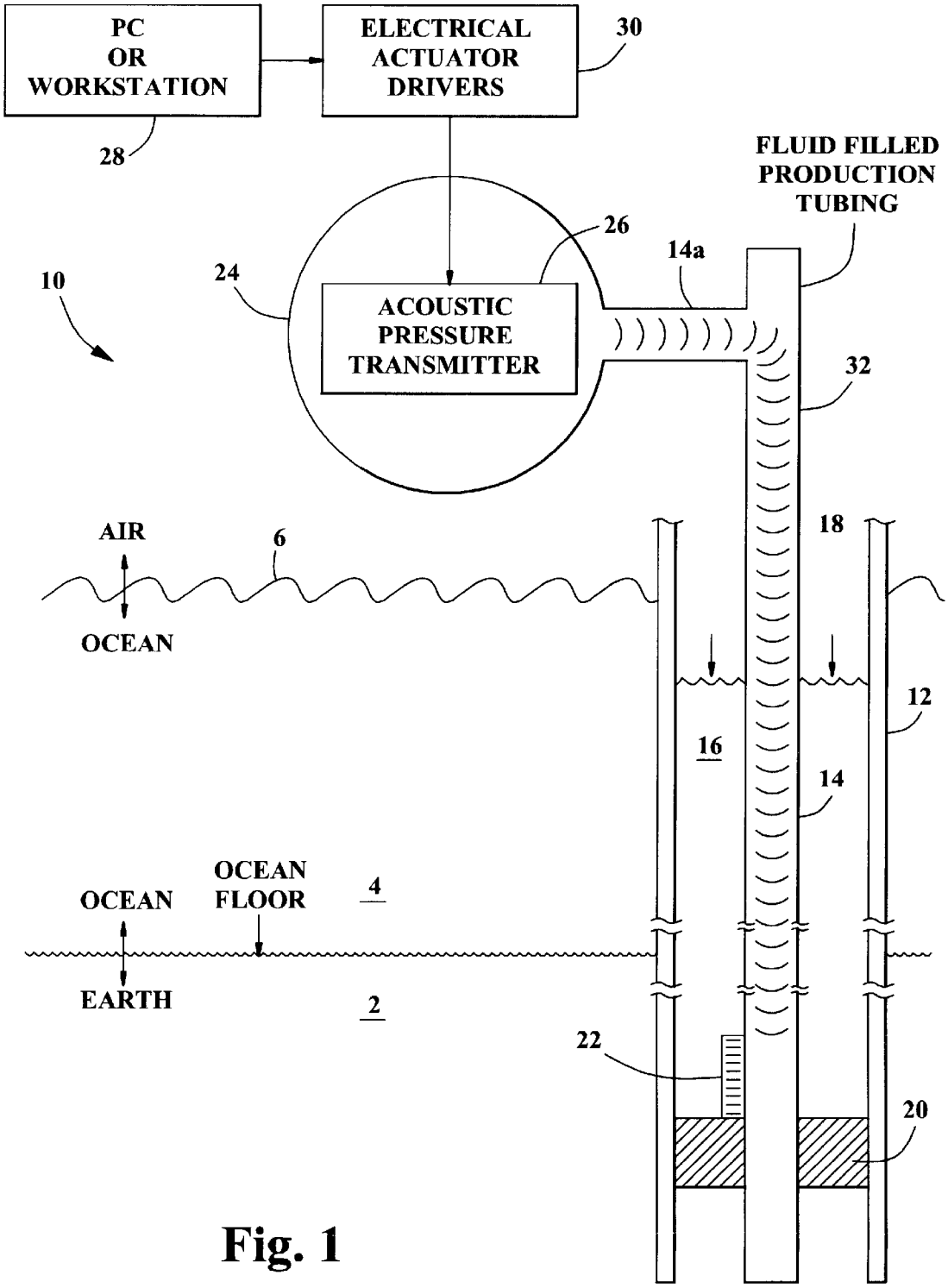
FIG. 1 is a schematic showing the general system of actuating a downhole device using a remote seismic source.
Figure 2:
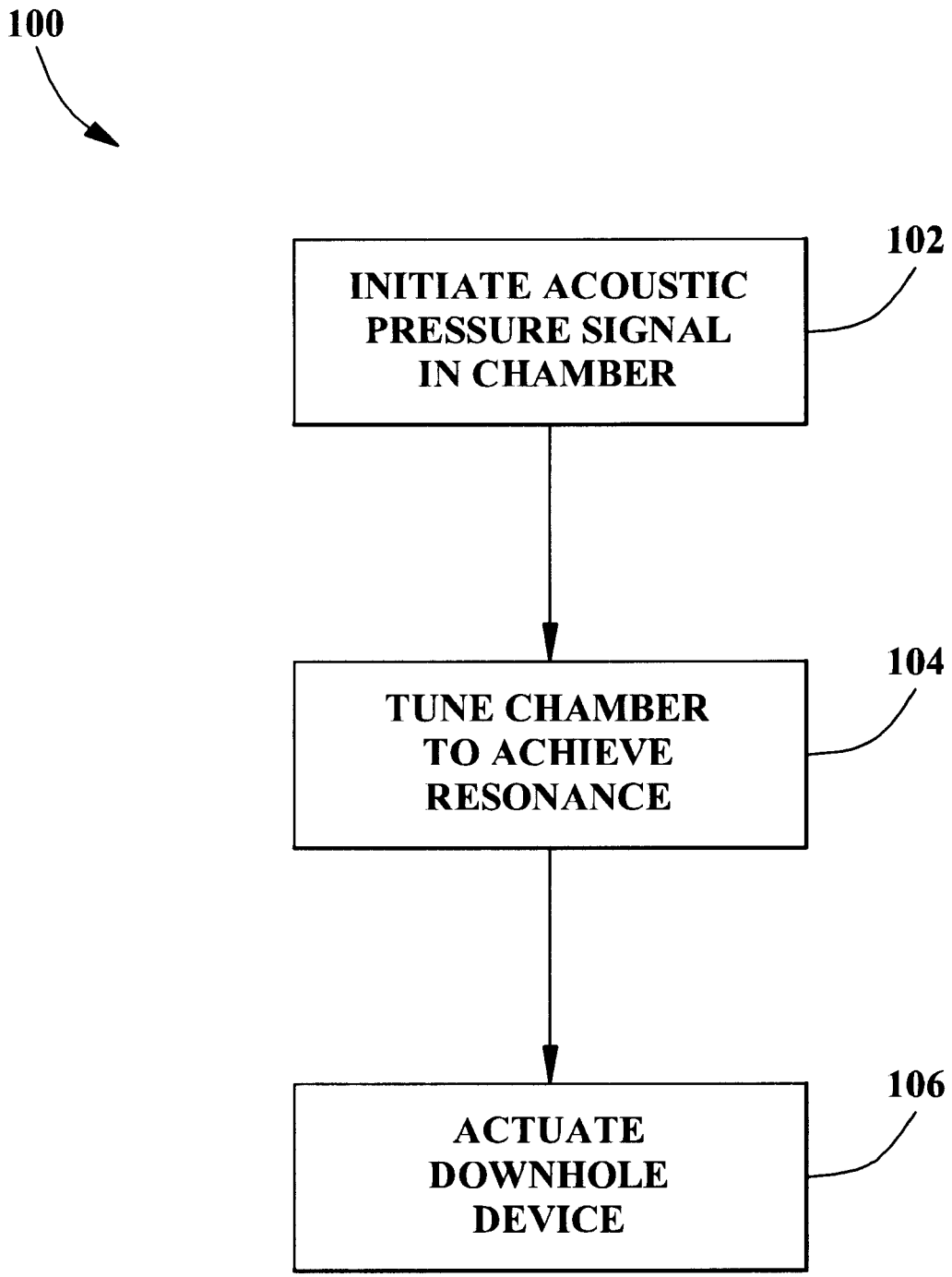
FIG. 2 is a flow chart showing the general method of actuating a downhole device using a resonant chamber enhanced signal.

The need to produce a remote actuation of a downhole device is satisfied by the apparatus and method disclosed in FIGS. 1 and 2. A system 10 embodying the present invention is best illustrated in FIG. 1. The system is applicable to shore or subsea completions. A subsea completion is shown for illustrative purposes only. A well is shown penetrating the earth 2 under the ocean 4 or other body of water. The well includes a casing 12 and a tool string 14 with an annulus 16 defined therebetween. The tool string could be a production string or a completion string. A downhole device 20 is shown between the tool string 14 and the casing 12. The downhole tool can be any tool that might be used during drilling or completion or after completion. For example, the tool could be a steering motor, a packer, a sliding side door, a perforation gun, a plug or other flow control device.

The casing and completion string can extend to a platform at the surface of the ocean 6, or the well can be completed with a well tree on the ocean floor. A first liquid level 18 is present in the annulus 16. The liquid level in the tool string 14 should be at least to the level of the transmitter 26. The transmitter 26 is located so that its output 32 is received within a resonance chamber 24. The resonance chamber is preferably tunable to accommodate a variety of output signal frequencies. Indeed, the chamber will be used to match the frequency of the gun to the unique geometry of the wellbore system. The acoustic source may be shot at several characteristic frequencies in order to analyze the best combination of frequency and amplitude to reach the desired depth in the well.

At least one receiver/actuator 22 is coupled to the downhole tool 20. The receiver/actuator 22 can be an acoustic transducer or a hydrophone which is matched to a transmitter 26. The receiver/actuator is preferably placed in the annulus against the tubing 14 to improve its ability to receive the transmitted signal 32. Likewise, an array of receivers might be used, each coupled to a single actuator. The use of an array of receivers along the outer surface of the tubing increases the likelihood that the signal will be received by at least one receiver. Further, while the signal 32 is shown in the tubing string, the signal could also be transmitted in a fluid column in the annulus 16.

A PC or workstation 28 can be used to initiate and code the signal burst. The initiation command is conveyed to the transmitter 26 by electrical actuator drivers 30. The drivers are relays that operate the valve on the seismic gun. The coding sequence can be as simple as a burst of predetermined duration, or a predetermined number of bursts of fixed duration. A modulated signal could also be used. The method 100 of using the resonated acoustic signal is disclosed in the flow chart of FIG. 2. First, an acoustic pressure signal is initiated 102 in a resonant chamber. Next, the chamber can be tuned to improve the amplification achieved by the resonance. Finally, the signal is received at the downhole tool which is actuated in response. The process can be repeated by initiating a second signal 108 to actuate 110 a second device. Further, the same signal could be used to actuate a device and then deactuate the device.

Although preferred embodiments of the present invention have been described in the foregoing Detailed Description and illustrated in the accompanying drawings, it will be understood that the invention is not limited to the embodiments disclosed, but is capable of numerous rearrangements, modifications, and substitutions of steps without departing from the spirit of the invention. Accordingly, the present invention is intended to encompass such rearrangements, modifications, and substitutions of steps as fall within the scope of the appended claims.

We claim:

1. A method of remotely actuating a downhole device within a well comprising the steps of:

(a) initiating an actuation signal within a variably tunable resonant chamber;

(b) amplifying the actuation signal within the resonant chamber;

(c) communicating the amplified signal to the downhole device; and (d) actuating the device in response to the amplified signal.

2. The method of claim 1 wherein step (a) comprises initiating a signal using an acoustic source.

3. The method of claim 1 wherein step (a) comprises initiating a coded signal.

4. The method of claim 1 wherein step (a) comprises initiating a first coded signal to initiate a first downhole device.

5. The method of claim 1 wherein step (a) comprises initiating a signal for a sufficient duration to allow an amplification to occur in the resonant chamber.

6. The method of claim 1 wherein step (d) comprises actuating a packer.

7. The method of claim 1 wherein step (d) comprises actuating a sliding side door.

8. The method of claim 1 wherein step (d) comprises actuating a perforation gun.

9. The method of claim 1 wherein step (d) comprises actuating a flow control device.

10. The method of claim 1 further comprises:

(c) initiating a second signal; and (d) actuating a second device in response to the second signal.

11. The method of claim 1 further comprises tuning the resonant chamber.

12. The method of claim 11 comprises initiating a plurality of signals to determine an optimum signal.

13. The apparatus of claim 11 wherein the receiver is mounted on an outer surface of a tubing string for the well.

14. The apparatus of claim 11 wherein the receiver is a transducer.

15. The apparatus of claim 11 wherein the receiver is a hydrophone.

16. The apparatus of claim 11 wherein the at least one receiver comprises an array of receivers mounted within the well.

17. The apparatus of claim 11 wherein the device comprises a packer.

18. An apparatus for the remote actuation of a downhole device in a well, comprising:

(a) a transmitter coupled to a signal generation means and located within a resonant chamber;

(b) means to variably tune said resonant chamber to enhance a signal generated by said signal generation means;

(c) an actuator coupled to the device;

(d) at least one receiver coupled to the actuator;

(e) means to communicate the enhanced signal from said resonant chamber to said receiver.

* * * * *